US007303454B2

(12) United States Patent
Cheung

(10) Patent No.: US 7,303,454 B2
(45) Date of Patent: Dec. 4, 2007

(54) SIDE-REINFORCED MULTI-LAYERED SPORTS BOARD

(76) Inventor: Wah Kan Cheung, 18 Bilberry Crescent, Richmond Hill, Ontario (CA) L4S 2M4

( * ) Notice: Subject to any disclaimer, the term of this patent is extended or adjusted under 35 U.S.C. 154(b) by 29 days.

(21) Appl. No.: 11/325,297

(22) Filed: Jan. 4, 2006

(65) Prior Publication Data

US 2006/0116038 A1 Jun. 1, 2006

Related U.S. Application Data

(63) Continuation-in-part of application No. 10/797,995, filed on Mar. 11, 2004, now Pat. No. 7,150,666.

(51) Int. Cl.
*B63B 35/81* (2006.01)

(52) U.S. Cl. ..... 441/74; 114/357

(58) Field of Classification Search ..... 441/65, 441/74, 68; 428/316.6, 308.4, 318.6, 319.3, 428/319.7, 319.9; 114/357
See application file for complete search history.

(56) References Cited

U.S. PATENT DOCUMENTS 4,850,913 A * 7/1989 Szabad, Jr. ..... 441/65

5,882,776 A * 3/1999 Bambara et al. ..... 428/215

* cited by examiner

*Primary Examiner*—Ed Swinehart
(74) *Attorney, Agent, or Firm*—Clement Cheng

(57) ABSTRACT

A sports board (15) comprising an elongated expanded closed-cell polyolefin foam core (16) having an upper surface (18), an opposed lower surface (19), a side surface (20) extending between the upper surface and the lower surface, a core density and a core thickness, a top polyolefin film layer (21) having an inner surface (22), an outer surface (23), a top film density and a top film thickness less than the core thickness, an intermediate metallocene-based polyolefin layer (24) having an intermediate thickness less than the core thickness and laminated directly between the upper surface of the core and the inner surface of the top layer, an expanded polyolefin foam side strip (25) having an inner surface (26), an outer surface (28) and a side strip density greater than the core density, the inner surface of the side strip laminated to the side surface of the core to cover, partially or completely, the side surface of the core, and a bottom polyolefin film layer (29) having an outer surface (30), an inner surface (31), a bottom film density and a bottom film thickness less than the core thickness, the bottom film layer laminated to the core.

23 Claims, 5 Drawing Sheets

SIDE-REINFORCED MULTI-LAYERED SPORTS BOARD

This application is a continuation-in-part of U.S. patent application Ser. No. 10/797,995, filed Mar. 11, 2004 now U.S. Pat No. 7,150,666.

TECHNICAL FIELD

The present invention relates to foam sports boards for recreational use and, more particularly, to a laminated board with improved characteristics.

BACKGROUND ART

Body boards for riding waves and other recreational sports boards made of foam or other floatation material are known in the prior art. In general, such sports boards are composed of a number of layers thermally or adhesively bonded together. The boards generally have a closed-cell foam core covered by one or more layers adhesively or thermally bonded to the core.

A number of laminated boards are known in the prior art and a number of methods of laminating or bonding the various layers of the board together are known. Examples of such boards and methods of laminating them are shown and disclosed in U.S. Pat. Nos. 5,211,593, 5,658,179, 5,503,921, 4,850,913 and 5,275,860. In bonding the layers together it is desirable to provide a bond between two layers which is stronger than the strength of the layers themselves.

It is known in the prior art that an adhesive may be used to bond the various layers together. This method of bonding has a number of drawbacks, including the adverse affect of solvent vapors released into the air during the manufacturing process and the added weight to the board of an adhesive joint. In addition, many conventional adhesives eventually deteriorate over time from the adverse affect of salt water on the adhesive, causing delamination.

It is also known that heat may be used to bond the various layers together. However, boards known in the prior art generally require that the thermal laminating process by which they are made occur at very high and exact temperatures in order to properly bond the layers. The requirement for a high and exact bonding temperature necessitates a more elaborate laminating process and can cause undesirable shrinkage of the layers. This type of bonding is especially difficult when the layers are of different materials having different thermal characteristics.

For example, it is known that polyethylene foam sports boards can be covered with an outer skin surface of non-foam plastic materials for drag reduction or for applying a printed graphics to decorate the sports board. Various techniques are known in the prior art to laminate such a slick plastic film to the foam core of the board. For example, U.S. Pat. No. 4,850,913 teaches the process of heat laminating a polyethylene film to a thin polyethylene foam sheet, and then heat laminating the resulting film-foam laminant to a low-density polyethylene foam core. This intermediate foam sheet is sometimes referred to as a backing foam layer. Similar, U.S. Pat. No. 5,658,179 teaches a body board having a slick polymer film applied to the bottom of the board and having an outer high density core laminated to a lower density inner foam core. However, these fabrication techniques require including a high density foam sheet (backing foam) between the outer film layer and the foam core to improve and provide proper bonding between the film and low density foam core.

Some manufacturers have attempted to heat laminate a plastic film directly to a foam core without a backing layer of high density foam between the outer film layer and the foam core. An example of this is shown in U.S. Pat. No. 5,211,593. The board shown in U.S. Pat. No. 5,211,593 includes a graphic imprinted dual film layer heat laminated to a foam core by pressing the film layer against the foam core surface after the foam core surface has been heated to a desired temperature range. Another example of this direct lamination technique is disclosed in U.S. Patent Publication No. 2002/0167136. However, such direct lamination techniques require high and exact temperature ranges to achieve proper fusion bonding between the outer film layer and the inner foam core. The intense heat involved in such a neat lamination process also may cause undesirable shrinkage of the film layer, particularly with thin gauge polymer films. The heating process may also cause unnecessary melting of the foam surface layer, which may result in a rough finish on the film surface or blistering at the interface between the foam layer and the film layer. In addition, boards without an intermediate foam layer often do not have the desired comfort or softness on top of the board, do not absorb collision forces effectively, and do not provide adequate flexural strength.

Accordingly, there is a need for a sports board that can be manufactured cost effectively, has a comfortable riding surface, and includes a sharp and distinct graphic imprinted outer film layer, a slick plastic bottom skin with good surface smoothness, good bonding between the layers, and protection against impact forces.

DISCLOSURE OF THE INVENTION

With parenthetical reference to the corresponding parts, portions or surfaces of the disclosed embodiment, merely for the purposes of illustration and not by way of limitation, the present invention provides an improved sports board (15) comprising an elongated expanded closed-cell polyolefin foam core (16) having an upper surface (18), an opposed lower surface (19), a side surface (20) extending between the upper surface and the lower surface, a core density and a core thickness, a top polyolefin film layer (21) having an inner surface (22), an outer surface (23), a top film density and a top film thickness less than the core thickness, an intermediate metallocene-based polyolefin layer (24) having an intermediate thickness less than the core thickness and laminated directly between the upper surface of the core and the inner surface of the top layer, an expanded polyolefin foam side strip (25) having an inner surface (26), an outer surface (28) and a side strip density greater than the core density, the inner surface of the side strip laminated to the side surface of the core to cover, partially or completely, the side surface of the core, and a bottom polyolefin film layer (29) having an outer surface (30), an inner surface (31), a bottom film density and a bottom film thickness less than the core thickness, the bottom film layer laminated to the core.

The top film layer may be a non-foam polymer material selected from a group consisting of polyethylene, polypropylene, polyethylene and polypropylene, and polyethylene and ethylene vinyl acetate. The top film layer may comprise a first layer (33) and a second graphically imprinted layer (32) laminated to the first layer. The core may comprise a foam selected from a group consisting polyethylene foam, polypropylene foam, polyethylene ethylene vinyl acetate copolymer foam, polyethylene polypropylene copolymer foam, and polyethylene polystyrene copolymer foam. The side strip may comprise a foam selected from a group consisting of polyethylene foam, polypropylene foam, polyethylene ethylene vinyl acetate copolymer foam, polyethylene polypropylene copolymer foam, and polyethylene polystyrene copolymer foam. The side strip may comprise a first foam layer (34) laminated to a second foam layer (35) or the side strip may comprise a laminated first foam layer, second foam layer and third foam layer. The intermediate layer may comprise an ethylene-alpha olefin copolymer and may comprise a copolymer of ethylene and octene. The intermediate layer and the top layer may extend such that the intermediate layer is laminated between the side strip and the top layer to cover, partially or completely, the outer surface of the side strip. The board may further comprise a second intermediate metallocene-based polyolefin layer (36) having a second intermediate thickness less than the core thickness laminated between the lower surface of the core and the inner surface of the bottom film layer. The bottom polyolefin film layer may be a non-foam polymer material selected from a group consisting of polyethylene, polypropylene, polyethylene and polypropylene, and polyethylene and ethylene vinyl acetate. The bottom film layer may comprise a first layer and a second graphically imprinted layer laminated to the first layer. The bottom film layer may further comprise an outside third layer laminated to the first and second layers.

Accordingly, the general object of the present invention is to provide an improved sports board with a comfortable riding surface, a distinct graphic image imprinted on the riding surface, and side impact cushioning.

Another object is to provide a sports board having a wrinkle free surface.

Another object is to provide a sports board manufactured in a more cost effective manner.

Another object is to provide a sports board which may be manufactured using a conventional extrusion machine and heat laminating machine.

Another object is to provide a sports board having side wall protection against minor impact forces from use.

Another object is to provide a sports board having a bumper strip for added protection on the perimeter of the board.

Another object is to provide a sports board having suitable stiffness.

Another object is to provide a sports board which may be manufactured without a backing foam.

Another object is to provide a sports board able to adsorb collision forces.

Another object is to provide a sports board with foam tear strength bonds.

Another object is to provide a sports board in which different polyolefin materials may be used in the layers without a derogation in bonding strength.

Another object is to provide a sports board which permits the layers to be laminated together at lower and less exact temperature ranges.

Another object is to provide a sports board which is manufacturable without deleterious foam shrinkage.

Another object is to provide a sports board which has visible perimeter color strips.

DESCRIPTION OF THE PREFERRED EMBODIMENTS

Figure 1:
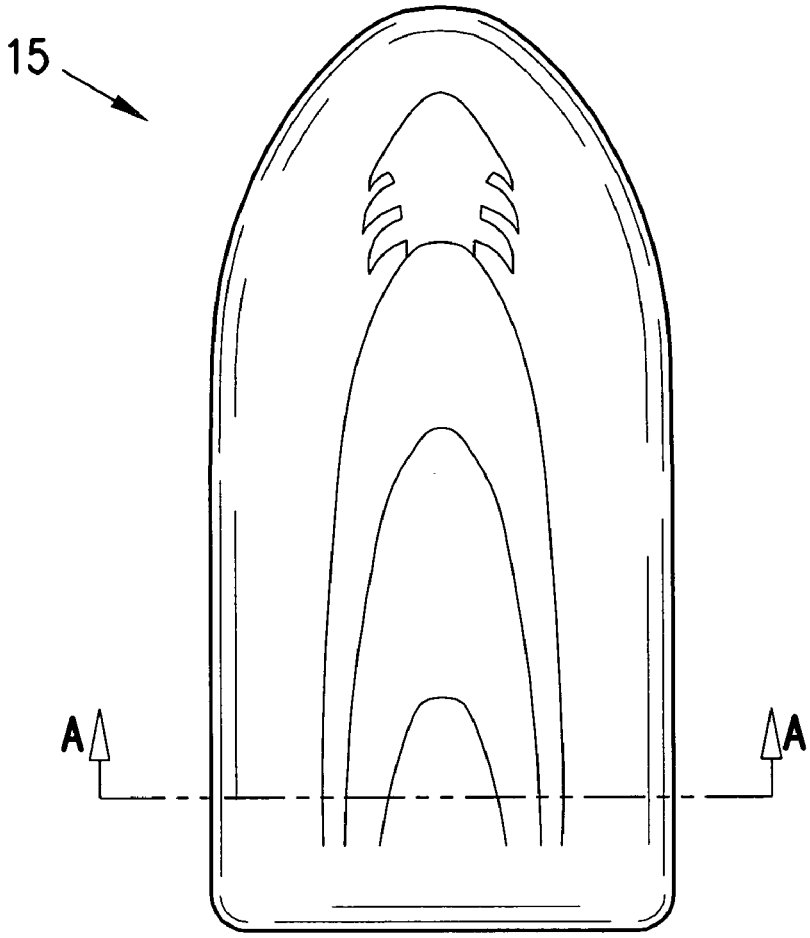
FIG. 1 is a perspective view of a first embodiment of the sports board.

At the outset, it should be clearly understood that like reference numerals are intended to identify the same structural elements, portions or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
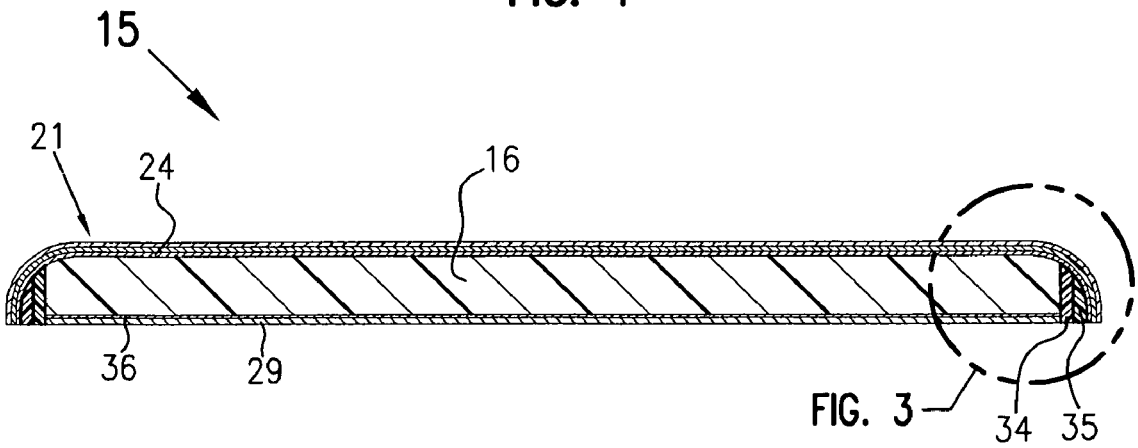
FIG. 2 is a transverse vertical sectional view of the sports board shown in FIG. 1, taken generally on line A-A of FIG. 1.
Figure 3:
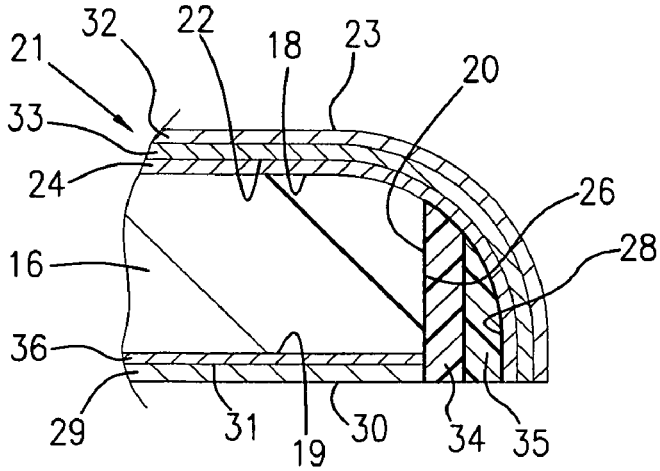
FIG. 3 is an enlarged detailed view of the sports board shown in FIG. 2, taken within the indicated circle of FIG. 2.

Referring now to the drawings and, more particularly, to FIGS. 1-3 thereof, this invention provides an improved sports board, the presently preferred embodiment of which is generally indicated at 15. As shown in FIGS. 1-3, sports board 15 has six horizontally extending layers laminated together.

Top layer 32 is graphically imprinted polyethylene film. The graphics on layer 32 are imprinted using any of several conventional processes for printing on polyethylene. An example of such a process is corona printing, in which an electrical discharge temporarily alters the surface molecules of the polyethylene film, allowing inks to adhere to the film. Layer 32 has a thickness of between about 0.02 and 0.15 mm, and preferably a thickness of about 0.07 mm. Layer 32 has a density of between about 0.91 and 0.98 g/cm$^3$, and preferably a density of about 0.95 g/cm$^3$. Layer 32 is typically adhesively laminated to the outer surface of layer 33.

Layer 33 is polyethylene film. Layer 33 has a thickness of between about 0.01 and 0.15 mm, and preferably a thickness of about 0.05 mm. Layer 33 has a density of between about 0.91 and 0.98 g/cm$^3$, and preferably a density of about 0.95 g/cm$^3$. The inner surface 22 of layer 33 is laminated to the outer surface of layer 24.

Layer 24 is metallocene-catalyzed polyolefin resin. In the preferred embodiment, layer 24 is an ethylene-olefin copolymer of ethylene and octene produced in a conventional solution polymerization process using a metallocene catalyst. Metallocene is used as an olefin polymerization catalyst to form a metallocene-based copolymer. Layer 24 has a thickness of between about 0.01 and 0.3 mm, and preferably a thickness of about 0.05 mm. Layer 24 has a density of between about 0.86 and 0.98 g/cm$^3$, and preferably a density of about 0.9 g/cm$^3$. The inner surface of layer 24 is laminated to outer surface 18 of layer 16.

Layer 16 is closed-cell low density polyethylene foam, and acts as the core of board 15. Core 16 may be beaded type, extruded type or cross-linked polyethylene foam. Core 16 has a thickness of between about 0.25 and 2 inches, and preferably a thickness of about 1.25 inches. Core 16 has a density of between about 1.6 and 8 lb/ft$^3$, and preferably a density of about 3 lb/ft$^3$. It is contemplated that foam core 16 may be formed from two or more layers laminated together to form a 1.25 inch thick foam core. The lower surface 19 of layer 16 is in turn laminated to the inner surface of layer 36.

Layer 36 is of the same structure and composition as layer 24. The outer surface of layer 36 is laminated to the inner surface 31 of bottom layer 29. This intermediate layer provides a superior bond between polyethylene foam and polyethylene film.

Layer 29 is high density polyethylene slick film. Layer 29 has a thickness of between about 0.3 and 1.5 mm, and preferably a thickness of about 0.7 mm. Layer 29 has a density of between about 0.91 and 0.98 g/cm$^3$, and preferably a density of about 0.95 g/cm$^3$. The bottom surface 30 of layer 29 provides the bottom surface for board 15. Top surface 23 of layer 32 provides the top surface of board 15.

As shown in FIG. 3, board 15 also includes a vertically extending side strip around the perimeter of the board. In embodiment 15, the side strip comprises two laminated layers 34 and 35. Inner layer 34 is closed-cell high density polyethylene foam. Layer 34 has a thickness of between about 2 and 10 mm, and preferably a thickness of about 3.5 mm. Layer 34 has a density of between about 4 and 10 lb/ft$^3$, and preferably a density of about 7 lb/ft$^3$. The upper portion of the inner side surface of layer 34 is laminated to the side surface 20 of core 16 and a lower portion of the inner side surface of layer 34 is laminated to the edges of layers 36 and 29. Layer 35 is similarly a high density polyethylene foam sheet having a thickness of between about 2 and 10 mm, and preferably a thickness of 3.5 mm. Strip 35 also has a density of between about 4 and 10 lb/ft$^3$, and preferably a density of 7 lb/ft$^3$. As shown, the inner surface of strip 35 is laminated to the outer surface of strip 34 and the outer perimeter portion of layers 21, 32 and 33 are wrapped over and laminated to the outside curved surface of layer 35. This foam side strip has a density greater than the density of the foam core but less than the density of the non-foam film layer 21.

Figure 8:
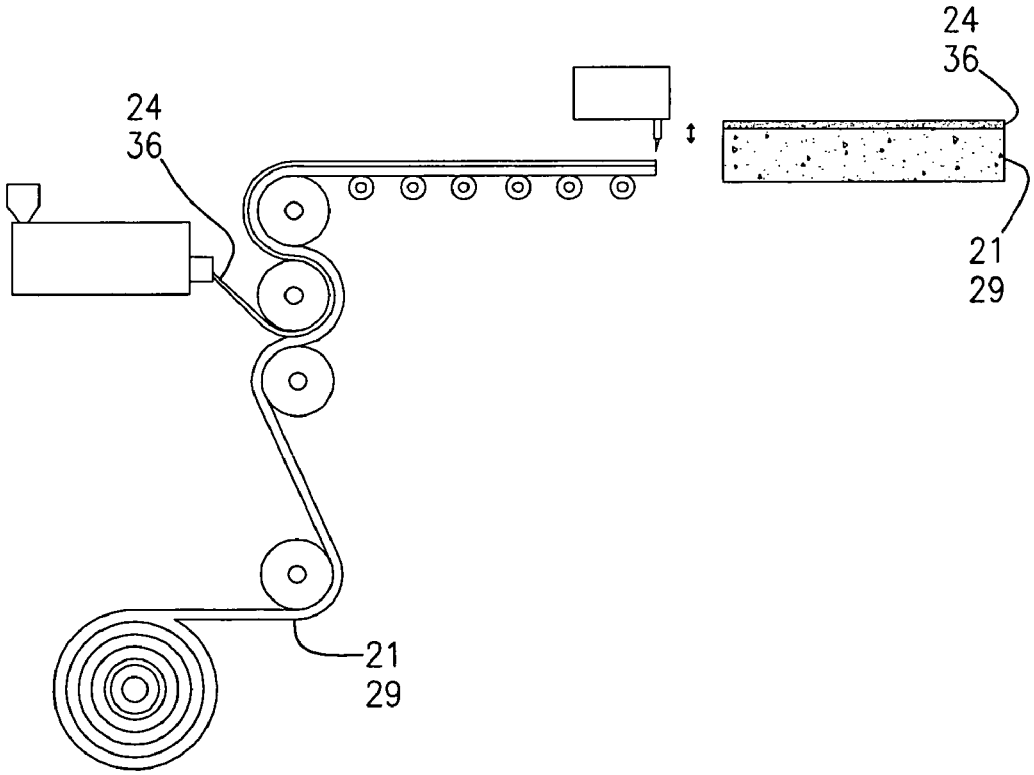
FIG. 8 is a schematic showing the process by which an intermediate resin layer is applied to a bottom or top film layer.
Figure 9:
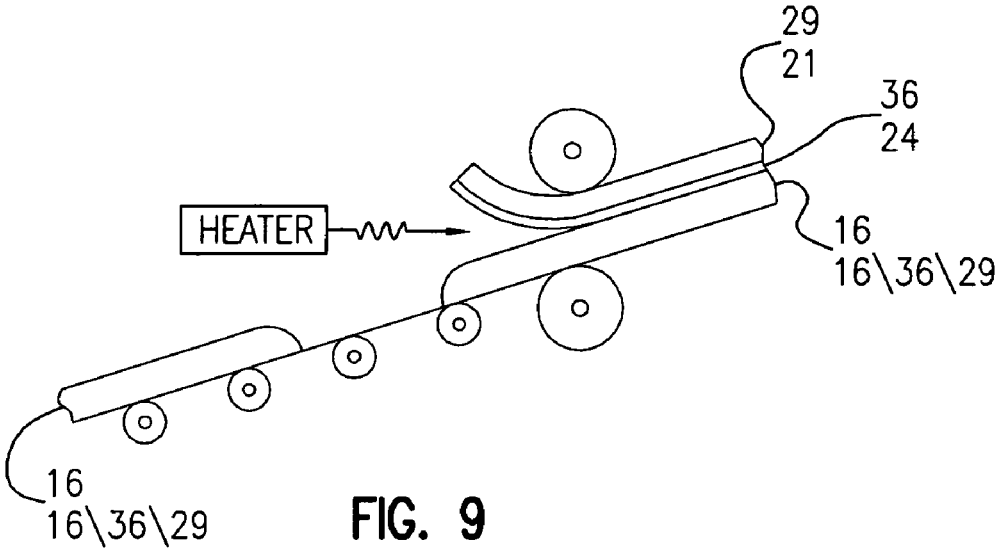
FIG. 9 is a schematic showing the process by which the laminated bottom film layer and intermediate resin layer or the laminated top film layer and intermediate film layer are bonded to the core layer.
Figure 10:
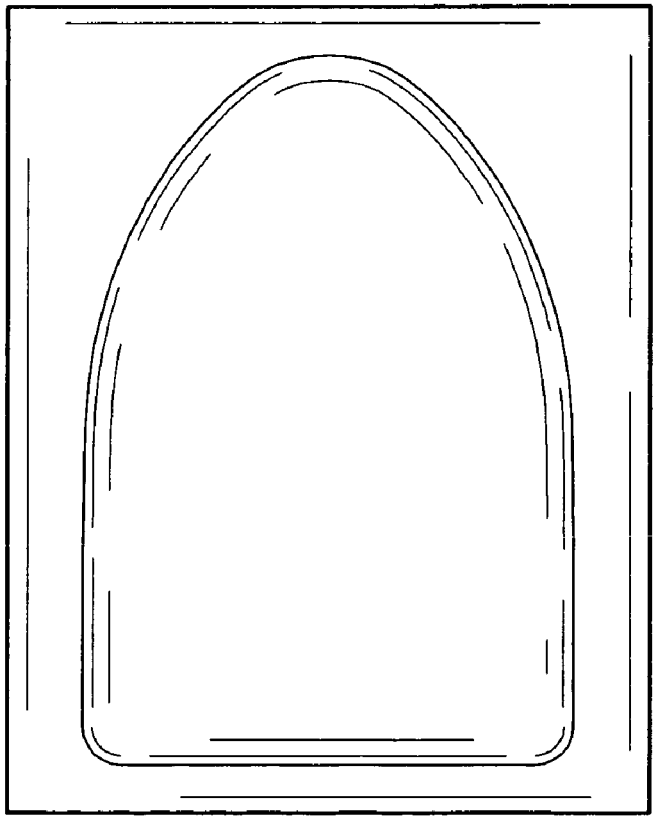
FIG. 10 shows the die for cutting the preliminary shape of the board.

Sports board 15 is formed in a series of steps. First, foam core 16 is cut from a polyethylene foam plank to the desired size and shape. As shown in FIG. 8, film layer 29 is then fed from a roller and resin layer 36 is extruded, using a conventional extrusion process, onto the inner surface 31 of layer 29 to form a laminate sheet 29/36 of layers 29 and 36. This laminated sheet 29/36 is then cut and configured to the same size as bottom surface 19 of core 16. Laminate 29/36 is then heat laminated to the bottom surface 19 of core 16 as shown in FIG. 9. The resulting laminating board 29/36/16 is then die cut using the die shown in FIG. 10 to a desired shape.

Figure 11:
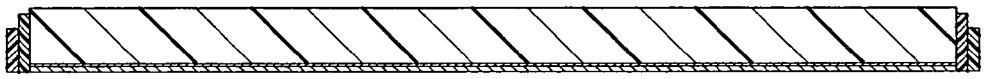
FIG. 11 is a transverse vertical sectional view of a partially constructed board after strips have been applied to the side surface of the board formed with the die shown in FIG. 10.
Figure 12A:
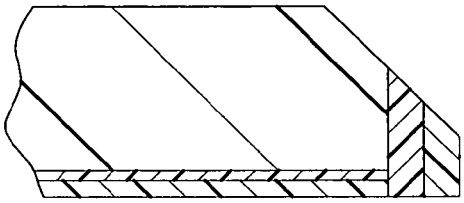
FIGS. 12*a* and 12*b* show the forming or shaping of the board as constituted in FIG. 11, with FIG. 12*a* showing a two layered side strip and FIG. 12*b* showing a single layered side strip.
Figure 12B:
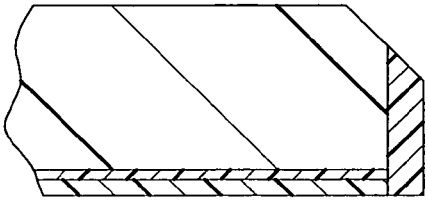

As shown in FIG. 11, side strips 34 and 35 are then heat laminated to cover the cut side edges of laminated board 29/36/16. Thus, strips 34 and 35 extend around the perimeter edge of laminated board 29/36/16. In the preferred embodiment, side strips 34 and 35 are heat laminated to cover the entire perimeter of the board. However, it is contemplated that these strips may be laminated to only cover part of the perimeter of the board, such as the front and side edges of the board but not the tail portion. Strips 34 and 35 are preferably cut and laminated such that their bottom surfaces are flush with the bottom surface 30 of film layer 29. As shown in FIG. 12*a*, the top perimeter edge of core 16 and strips 34 and 35 are then cut to provide the desired curvature to the top edge of the board.

Layer 32 is imprinted with the desired graphics using a conventional imprinting procedure. Layer 33 is then laminated to the inner surface of layer 32 to form laminate film layer 21. As shown in FIG. 8, film layer 21 is then fed from a roller and resin layer 24 is extruded, using a conventional extrusion process, onto the inner surface 22 of film layer 21 to form a laminate sheet 21/24 of layers 21 (32/33) and 24. Alternatively, it is contemplated that layer 33 may be formed with layer 32 on one side and adhesive resin 24 on the other side by using a conventional co-extruder. Laminated sheet 21/24 is then cut and generally configured to the shape of board 29/36/16. This top laminate 21/24 is sized so that its outer edge will extend over the peripheral edge of core 16 enough so that it can be wrapped over, and heat laminated to, the top of strips 34 and 35 and the outer side surface of strip 35. As shown in FIG. 9, top laminate 21/24 is then heat laminated to the top surface 18 of core 16 and the outer perimeter portion of sheet 21/24 is wrapped over and laminated to cover the top edges of strips 34 and 35 and the outer side surface of strip 35. In the preferred embodiment, the perimeter edge of sheet 21/24 is folded over and trimmed flush with the bottom surface 30 of bottom layer 29.

By using resin layer 24 and a high density foam side strip positioned between the perimeter edge of graphic non-foam layer 21 and the side surface 20 of low density foam core 16, a backing foam layer over the entire core is not needed to facilitate a strong bond between the layers. This allows for a thinner board with a softer upper surface, and the side strips not only facilitate bonding but provide needed stiffness and a bumper to impacts to the edge of the board.

Figure 4:
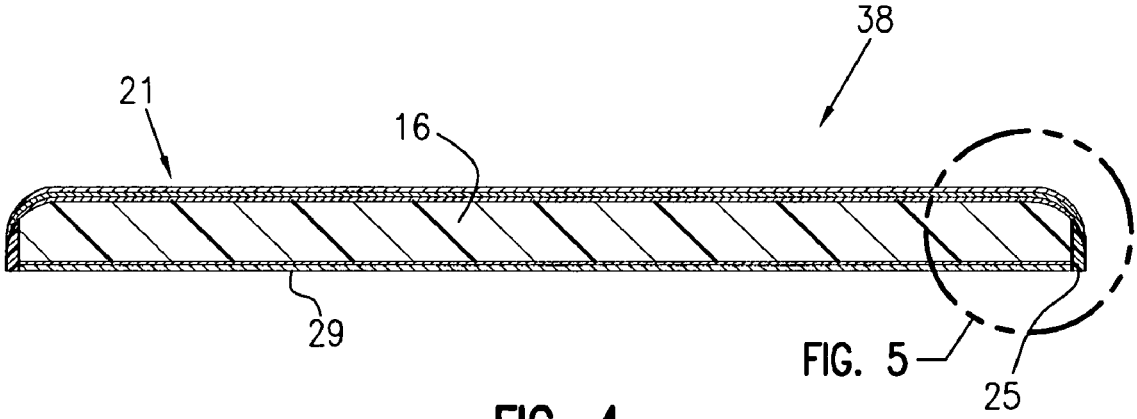
FIG. 4 is transverse vertical sectional view of a second embodiment of the sports board shown in FIG. 1, taken generally on line A-A of FIG. 1.
Figure 5:
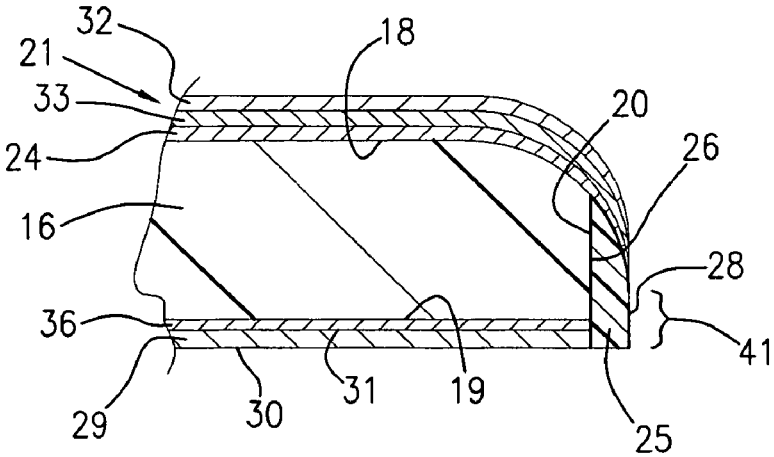
FIG. 5 is an enlarged detailed view of the sports board shown in FIG. 4, taken within the indicated circle of FIG. 4.

FIGS. 4-5 show a second embodiment 38. In this embodiment, the side strip of the board has only a single layer 25. Strip 25 is high density polyethylene foam. Strip 25 has a thickness between about 2 and 10 mm, and preferably a thickness of about 5 mm. Layer 25 has a density of between about 4 and 10 lb/ft$^3$, and preferably a density of about 7 lb/ft$^3$. Also, in this embodiment top laminate 24/21 does not extend down over the entire side surface of strip 25. Instead, laminate 21/24 only extends to a point just beyond the seam between the inner side surface of layer 25 and the side surface 20 of core 16. Thus, the tapered edge of laminate 21/24 is a distance 41 of about 0.4 inches from the bottom outside corner of layer 25. The other aspects of embodiment 38 are the same as in first embodiment 15.

Figure 6:
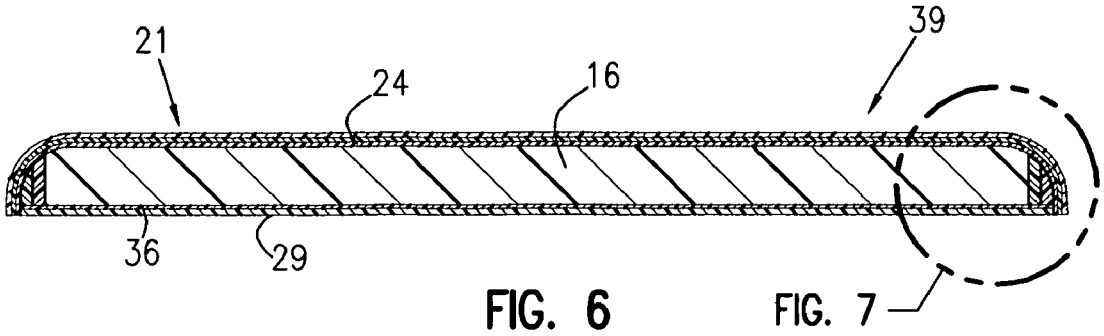
FIG. 6 is a transverse vertical sectional view of a third embodiment of the sports board shown in FIG. 1, taken generally on line A-A of FIG. 1.
Figure 7:
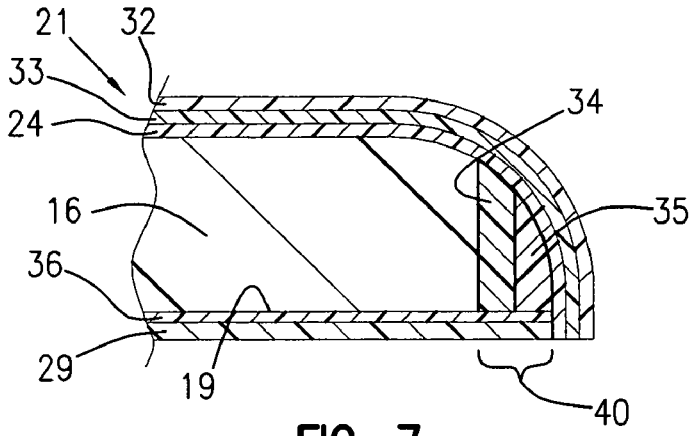
FIG. 7 is an enlarged detailed view of the sports board shown in FIG. 6, taken within the indicated circle of FIG. 6.

FIGS. 6-7 show a third embodiment 39. In this embodiment, bottom laminate 29/36 covers not only the bottom surface 19 of core 16, but also covers the bottom edges of strips 34 and 35. In this embodiment, laminate 29/36 is cut to extend an additional distance 40 beyond the perimeter edge of the bottom surface 19 of core 16 so that it will cover the exposed bottom ends of layers 34 and 35. The other aspects of embodiment 39 are the same as in first embodiment 15.

Intermediate layers 24 and 36 facilitate the bonding of polyethylene foam and polyethylene film using conventional thermal laminating processes. It is believed that such superior bonding is the result of the intermediate layers having a lower melt temperature than other materials, low shear viscosity, good wetting characteristics, and a linear molecular structure that diffuses quickly and forms a better physical bond with the molecules in the adjacent layers when cooled. In addition, it has been found that using a side strip 25, which has a density greater than the foam core and less than the outer film layer, between the outer edge portion of the film layer and the core helps facilitate bonding. This configuration permits a board to be made without having to apply a higher density backing foam layer over the entire surface of the core to keep the film layer from delaminating. The placement of the resin (24) and side strip (34/35 or 25) between the outer edge of the film layer (21) and the core (16) keeps the edges of the film layer from delaminating while also permitting a lower overall board thickness, good board stiffness, and greater softness on top of the board because a high density backing foam does not need to be applied over the top surface of the low density core.

The sports board may further include one or more handles attached to the top surface of the board. The handles are generally attached to the board by snap-rivets and snap-posts passing through apertures in the board and coupled with the board through a flexible strap member.

The present invention contemplates that many changes and modifications may be made. Therefore, while the presently preferred form of the sports board and two alternate embodiments have been shown and described, and certain modifications discussed, persons skilled in this art will readily appreciate that various additional changes and modifications may be made without departing from the spirit of the invention, as defined and differentiated by the following claims.

What is claimed is:

1. A sports board comprising:

(a) an elongated expanded closed-cell polyolefin foam core having an upper surface, an opposed lower surface, a side surface extending between said upper surface and said lower surface, a core density and a core thickness;

(b) a top polyolefin film layer having an inner surface, an outer surface, a top film density and a top film thickness less than said core thickness;

(c) an intermediate metallocene-based polyolefin film layer having an intermediate thickness less than said core thickness and laminated directly between said upper surface of said core and said inner surface of said top layer;

(d) an expanded polyolefin foam side strip having an inner surface, an outer surface and a side strip density greater than said core density, said inner surface of said side strip laminated to said side surface of said core to cover, partially or completely, said side surface of said core; and (e) a bottom polyolefin film layer having an outer surface, an inner surface, a bottom film density and a bottom film thickness less than said core thickness, said bottom film layer laminated to said core.

2. The board set forth in claim 1, wherein said top film layer is a non-foam polymer material selected from a group consisting of polyethylene, polypropylene, polyethylene and polypropylene, and polyethylene and ethylene vinyl acetate.

3. The board set forth in claim 1, wherein said top film layer comprises a first layer and a second graphically imprinted layer laminated to said first layer.

4. The board set forth in claim 1, wherein said core comprises a foam selected from a group consisting of polyethylene foam, polypropylene foam, polyethylene ethylene vinyl acetate copolymer foam, polyethylene polypropylene copolymer foam, and polyethylene polystyrene copolymer foam.

5. The board set forth in claim 1, wherein said side strip comprises a foam selected from a group consisting of polyethylene foam, polypropylene foam, polyethylene ethylene vinyl acetate copolymer foam, polyethylene polypropylene copolymer foam, and polyethylene polystyrene copolymer foam.

6. The board set forth in claim 1, wherein said side strip comprises a first foam layer laminated to a second foam layer.

7. The board set forth in claim 1, wherein said side strip comprises a laminated first foam layer, second foam layer and third foam layer.

8. The board set forth in claim 1, wherein said intermediate layer comprises an ethylene-alpha olefin copolymer.

9. The board set forth in claim 8, wherein said intermediate layer comprises a copolymer of ethylene and octene.

10. The board set forth in claim 1, wherein said intermediate layer and said top layer extend such that said intermediate layer is laminated between said side strip and said top layer to cover, partially or completely, said outer surface of said side strip.

11. The board set forth in claim 1, and further comprising a second intermediate metallocene-based polyolefin layer having a second intermediate thickness less than said core thickness laminated between said lower surface of said core and said inner surface of said bottom film layer.

12. The board set forth in claim 1, wherein said bottom polyolefin film layer is a non-foam polymer material selected from a group consisting of polyethylene, polypropylene, polyethylene and polypropylene, and polyethylene and ethylene vinyl acetate.

13. The board set forth in claim 11, wherein said bottom film layer comprises a first layer and a second graphically imprinted layer laminated to said first layer, wherein the graphic is sandwiched between the first layer and the second graphically imprinted layer.

14. The board set forth in claim 13, wherein said bottom film layer further comprises an outside third layer laminated to said first and second layers.

15. A sports board comprising:

(a) an elongated expanded closed-cell polyolefin foam core having an upper surface, an opposed lower surface, a side surface extending between said upper surface and said lower surface, a core density and a core thickness;

(b) a top polyolefin film layer having an inner surface, an outer surface, a top film density and a top film thickness less than said core thickness;

(c) an intermediate polyolefin film layer having an intermediate thickness less than said core thickness and laminated directly between said upper surface of said core and said inner surface of said top layer;

(d) an expanded polyolefin foam side strip having an inner surface, an outer surface and a side strip density greater than said core density, said inner surface of said side strip laminated to said side surface of said core to cover, partially or completely, said side surface of said core; and (e) a bottom polyolefin film layer having an outer surface, an inner surface, a bottom film density and a bottom film thickness less than said core thickness, said bottom film layer laminated to said core, wherein said intermediate layer and said top layer extend such that said intermediate layer is laminated between said side strip and said top layer to cover, partially or completely, said outer surface of said side strip.

16. The board set forth in claim 15, wherein said top film layer is a non-foam polymer material selected from a group consisting of polyethylene, polypropylene, polyethylene and polypropylene, and polyethylene and ethylene vinyl acetate.

17. The board set forth in claim 15, wherein said top film layer comprises a first layer and a second graphically imprinted layer laminated to said first layer.

18. The board set forth in claim 15, wherein said core comprises a foam selected from a group consisting of polyethylene foam, polypropylene foam, polyethylene ethylene vinyl acetate copolymer foam, polyethylene polypropylene copolymer foam, and polyethylene polystyrene copolymer foam.

19. The board set forth in claim 15, wherein said side strip comprises a foam selected from a group consisting of polyethylene foam, polypropylene foam, polyethylene ethylene vinyl acetate copolymer foam, polyethylene polypropylene copolymer foam, and polyethylene polystyrene copolymer foam.

20. The board set forth in claim 15, wherein said side strip comprises a first foam layer laminated to a second foam layer.

21. The board set forth in claim 15, wherein said side strip comprises a laminated first foam layer, second foam layer and third foam layer.

22. The board set forth in claim 15, and further comprising a second intermediate metallocene-based polyolefin layer having a second intermediate thickness less than said core thickness laminated between said lower surface of said core and said inner surface of said bottom film layer.

23. The board set forth in claim 15, wherein said bottom polyolefin film layer is a non-foam polymer material selected from a group consisting of polyethylene, polypropylene, polyethylene and polypropylene, and polyethylene and ethylene vinyl acetate.

* * * * *